US008434653B2

(12) United States Patent
Clark et al.

(10) Patent No.: US 8,434,653 B2
(45) Date of Patent: May 7, 2013

(54) PORTABLE BEDDING SYSTEM

(76) Inventors: Tony Leslie Clark, Knoxfield (AU); Lisa Maree Clark, Knoxfield (AU)

( * ) Notice: Subject to any disclaimer, the term of this patent is extended or adjusted under 35 U.S.C. 154(b) by 547 days.

(21) Appl. No.: 12/408,032

(22) Filed: Mar. 20, 2009

(65) Prior Publication Data

US 2010/0032459 A1 Feb. 11, 2010

(30) Foreign Application Priority Data

Mar. 20, 2008 (AU) ..... 2008901385

(51) Int. Cl.
*A45F 4/04* (2006.01)

(52) U.S. Cl.
USPC ..... 224/154; 224/156

(58) Field of Classification Search ..... 224/154, 224/156
See application file for complete search history.

(56) References Cited

U.S. PATENT DOCUMENTS

| | | | | |
|---|---|---|---|---|
| 3,620,428 | A * | 11/1971 | Silverthorne | 224/156 |
| 3,828,992 | A * | 8/1974 | Cerchione | 224/156 |
| 3,846,855 | A * | 11/1974 | Peterson | 5/114 |
| 5,210,891 | A * | 5/1993 | Avital et al. | 5/420 |
| 5,622,300 | A * | 4/1997 | Robinson | 224/575 |
| 6,243,892 | B1 * | 6/2001 | Kelling | 5/413 R |
| 7,171,707 | B2 * | 2/2007 | Landay | 5/413 R |
| 2006/0169729 | A1 * | 8/2006 | Reis | 224/154 |
| 2008/0054032 | A1 * | 3/2008 | Jones | 224/156 |
| 2008/0237281 | A1 * | 10/2008 | Robinson | 224/154 |

FOREIGN PATENT DOCUMENTS

AU 684704 12/1997

* cited by examiner

*Primary Examiner* — Brian D Nash
(74) *Attorney, Agent, or Firm* — Finnegan, Henderson, Farabow, Garrett & Dunner LLP

(57) ABSTRACT

A portable bedding system including bedding attached to a bag having a carrying arrangement. The bedding includes a ground sheet attached to a weather proof top sheet that is folded over the ground sheet to form an enclosure for a user, and the bedding can be packed into the attached bag.

21 Claims, 3 Drawing Sheets

PORTABLE BEDDING SYSTEM

FIELD OF THE INVENTION

The present invention relates to a portable bedding system, such as a swag, and particularly relates to, although is not limited to, a light-weight and portable bedding designed with the needs of homeless people in mind.

BACKGROUND OF THE INVENTION

A traditional swag, or portable bedding, comprises a bedding roll with a ground sheet and a cover under which a person may sleep on the ground or on a mattress. Variations of previously designed swags include an erectable canopy that can be constructed with the aid of additional support poles and ropes, and include a mosquito net to keep out insects and allow air to circulate under the canopy.

The traditional swag is usually packed away by either rolling it up and securing it with straps, or by packing it into a bag along with the poles, ropes, ground pegs and other attachments. The traditional swags are also often heavy and/or cumbersome.

In Australian petty patent 684704, a swag with an erectable insect-impervious zone in the form of a canopy is disclosed. The swag can also be further covered by a weatherproof canopy. Both canopies whilst erected require the use of support poles, guy lines and pegs which also have to be carried with the swag itself. The insect-impervious netting rolls up into a storage sack at the base of the bed, in which the dismantled support poles, guy lines and pegs are also stored. The swag itself is rolled up on itself and secured together with suitably attached straps. Bracing struts used to hold the canopy in position must also be removed and stored in the storage sack.

The result of this is a rolled up and difficult to carry swag comprising the added weight and bulk of bracing struts, dismantled support poles and ground pegs. Additionally, the swag itself is exposed to damage and soiling.

For a homeless person who must face the elements whilst sleeping outside, a weather-proof swag is an appropriate form of bedding conventionally available. However, for a homeless person without somewhere to store their belongings, and who must carry all that they own at any given time, the weight, bulk and impracticality of the currently available swags just is not practical for a person on the move. In addition, carrying around a large swag along with all of your belongings is a clear indication of homelessness, which can add to the indignity already felt by people in such a position.

Therefore, there is a need to provide a swag that is light-weight, portable, protective and practical.

SUMMARY OF THE INVENTION

According to the present invention, there is provided a portable bedding system comprising bedding attached to a bag having a carrying arrangement, the bedding comprising a ground sheet attached to a weather proof top sheet that is folded over the ground sheet to form an enclosure for a user, wherein the bedding can be packed into the attached bag.

The top sheet preferably includes a net for ventilation and protection from insects. The net can be attached to an inside of the top sheet at a location that is spaced from a head of the top sheet, and at a point above the pillow region, so that the top sheet can be folded on itself to expose the net which is left to hang in an opening at the top end of the bedding, thereby providing protection from insects and ventilation to the bedding region. The net may be fastened against the top sheet using fasteners and/or can be detachable from the top sheet altogether.

In one form the bag is attached to a head of the bedding. Where a net is used, the net is able to extend over the bag. The bag may alternatively be attached at the base of the bedding. The bag and bedding may be releasably attached by way of fasteners.

In one embodiment of the present invention, the bedding can be laid out by being rolled out and slept on and the user's belongings can be stored in the attached container. The top sheet can extend over the backpack such that a canopy is formed that covers both the bedding region and the backpack. This allows the user to sleep with their belongings safely contained inside the canopy.

In one form, the canopy is erected via eyelets strategically placed on the top sheet such that a canopy is formed when ropes which are attached to the eyelets are tethered to an object, for example, a tree.

In one form, the ropes which are attached to the eyelets can be folded or rolled up when not in use and placed in rope pockets. The ropes cannot be lost or detached from the swag.

In another form, both layers can be rolled back allowing the user to sleep with the pillow region and the bag region exposed to the elements if desired.

In one form, the bag is made of light-weight, waterproof material of a dark colour so as to hide soiling. The bag may be made from light-weight and waterproof canvas.

In one form, the ground sheet is made from a waterproof plastics material.

In one form, the attached bag is in the form of a backpack. The backpack is made from light-weight and waterproof canvas. The backpack may include a padded back section for improved comfort and sweat adsorption. In one form, the backpack includes a yolk to improve the comfort on a user's back. The base panel of the backpack may be made from waterproof plastic-type material.

In another form, the ground sheet is able to be opened out to provide an enlarged floor area. This, together with the capability of the top sheet to form a canopy, allows the bedding system to double as a shelter in which to sit when the user is not sleeping.

In another embodiment the ground sheet is approximately twice as wide as the bag and can be folded over and fastened onto itself to form a pocket for a mattress. The mattress is not attached to the bedding but is able to be removed for easy cleaning.

BRIEF DESCRIPTION OF THE DRAWINGS

The present invention will now be described by way of example with reference to the accompanying drawings in which:

FIG. 7(*b*) is a schematic longitudinal cross section along section 7-7 of FIG. 6 with the net in a second extended position.

DETAILED DESCRIPTION OF THE INVENTION

Figure 1:
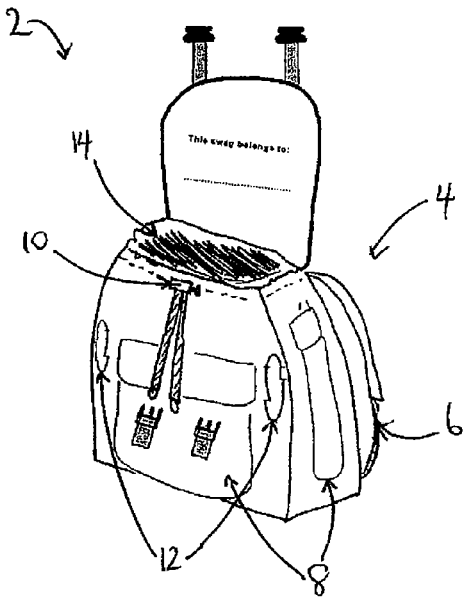
FIG. 1 is a perspective view of one form of a portable bedding system in a folded state.

The bedding system 2 of the present invention comprises a bag in the form of a backpack 4 with a carrying arrangement in the form of shoulder straps 6, a plurality of pockets 8, a drawstring 10 and a plurality of caribiners 12 for the attachment of other belongings. In the form shown in FIG. 1, bedding 14 is packed neatly and discreetly in the backpack 4.

Figure 2:
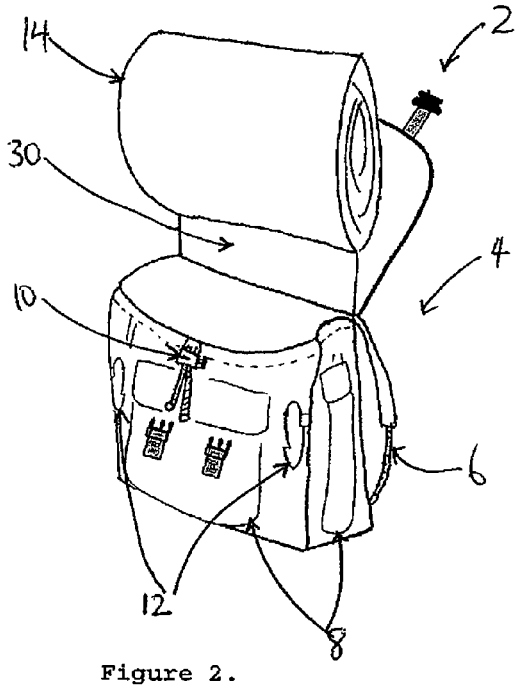
FIG. 2 is a perspective view of the portable bedding with a backpack with the bedding partially unrolled.

In FIG. 2, the bedding 14 has been partially unravelled and removed from the backpack in order to demonstrate the way in which the bedding may be unpacked from the backpack 4. The bedding 14 is attached to the backpack 4, either permanently or removably. In the embodiment shown the backpack attaches to the bedding at a head end 30 of the bedding.

The bag illustrated in the Figures is a backpack 4. It is understood that the bag may take any other form of receptacle including satchels with a shoulder strap as the carrying arrangement, or bag with handles. The bag need not only be used as a storage compartment for the bedding 14, but may have sufficient storage space to store personal belongings.

Figure 3:
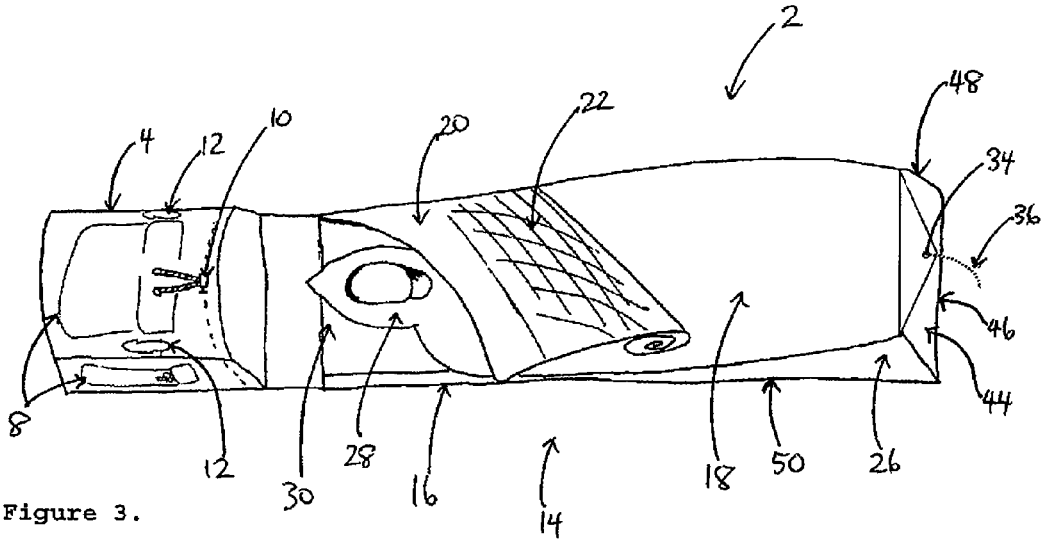
FIG. 3 is a perspective view of the rolled out portable bedding system wherein the top sheet is folded back and an insect net is not in use.
Figure 4:
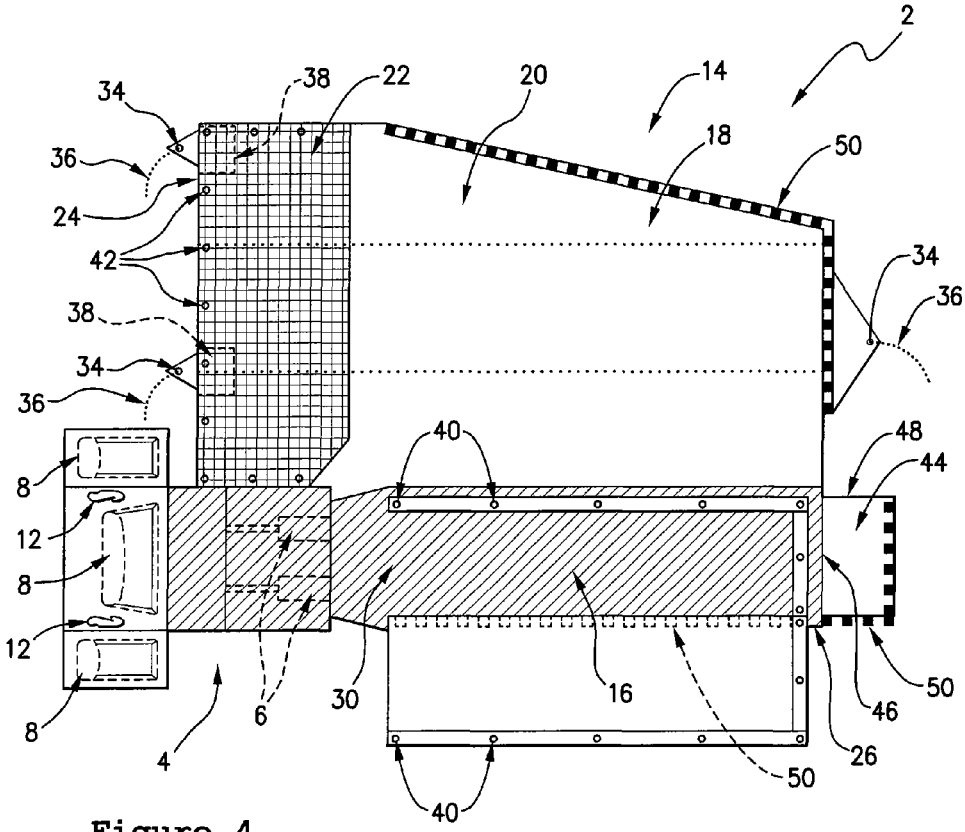
FIG. 4 is a plan view of the portable bedding system completely unfolded.

As illustrated in FIGS. 3 and 4 the bedding 14 comprises a ground sheet 16 attached to a water resistant top sheet 18. The top sheet includes an attached lining of insect-impervious net material 22.

As shown in FIG. 4 the backpack itself can be opened and unfolded to allow a user to gain easy access to the interior of the backpack and to make packing of the bedding easier.

The portable bedding system may include a mattress (not shown) which would lie in a pocket in the ground sheet 16. The ground sheet 16 includes a base end 26, from which end the bedding can be rolled up, folded or stuffed from the base end towards the head end 30 and into the attached backpack 4.

The portable bedding system 2 is designed for a user 28 to lie on the ground sheet 16, or mattress, with their head on head end 30 and top sheet folded over the user, and namely over the ground sheet, as illustrated in FIG. 3. The user 28 may sleep with the head end 30 and the backpack 4 exposed to the elements if desired.

Figure 5:
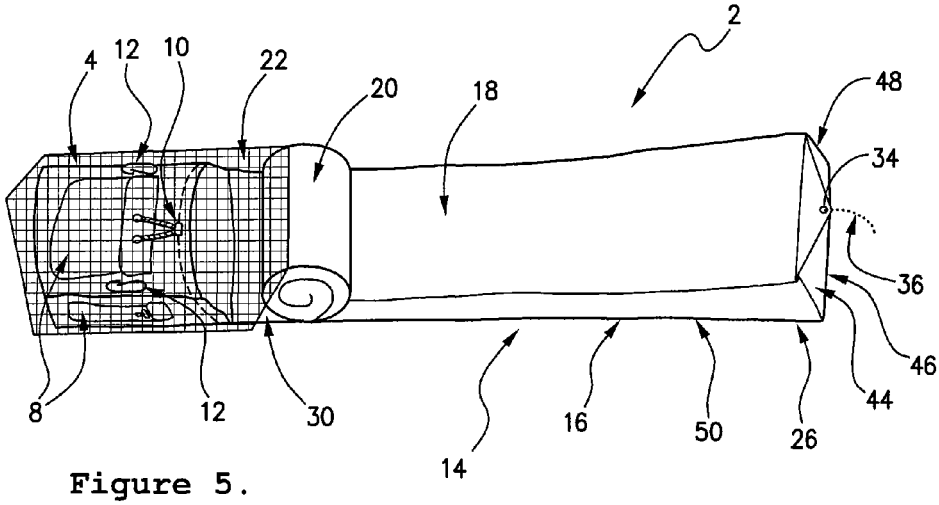
FIG. 5 is a perspective view of the rolled out portable bedding system wherein a top sheet is not in use but the insect net is in use.

Alternatively, the top sheet 18 can be rolled back such that the insect net 22 can be extended over the user's head and the backpack 4 to provide protection from insects and ventilation to the bedding 14. FIG. 5 illustrates this arrangement, but without showing a user.

Insect net 22 is illustrated attached, either permanently or removably, to an inside 20 of the top sheet and at a location spaced away from the edge of the top sheet at its head, or top, edge 24. This allows a user to have the option of rolling both the top sheet 18 and net 22 away from the user's head, folding only the top sheet over and leaving the net over the user's head as shown in FIG. 5, or creating an enclosed canopy 32 by pulling both the net and top sheet 18 over the user's head and backpack as illustrated in FIGS. 6, 7(*a*) and 7(*b*).

Alternatively insect net 22 may be attached to the top edge 24 of top sheet 18 or to an exterior of the top sheet 18, and could be a suitable arrangement for certain relative lengths of cover sheet 18 to net 22.

Net 22 may be attached to top sheet 18 by stitching, welding, adhesive, rivets, staples, releasable press studs, snaps, hooks, Velcro®, buttons, a zip, or the like. To keep net 22 flat against top sheet 18 as illustrated in FIG. 4, releasable fasteners 42 are provided around the perimeter of net 22 to attach it to top sheet 18. Insect net 22 may be impregnated with an insect repellent.

Figure 6:
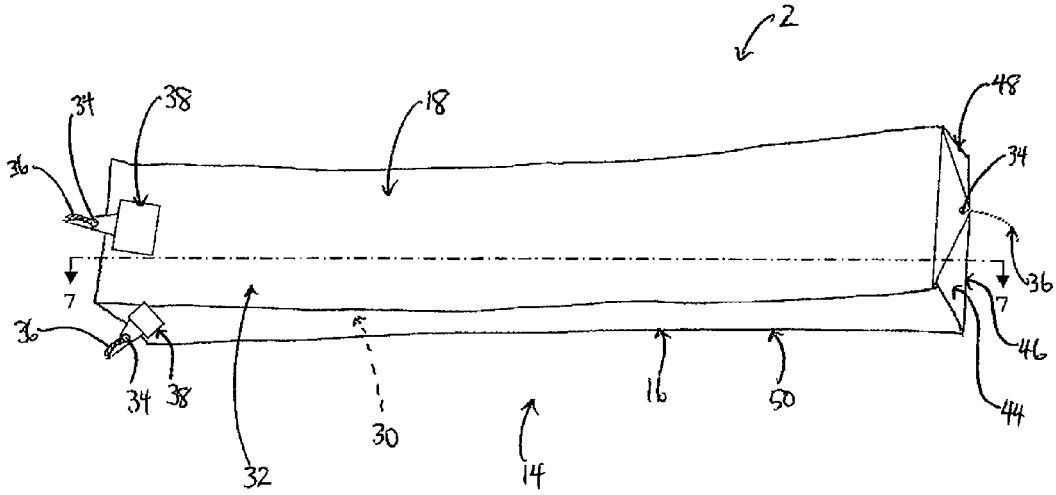
FIG. 6 is a perspective view of the rolled out portable bedding system wherein the top sheet is extended over the entire bedding system to form an enclosed canopy.
Figure 7A:
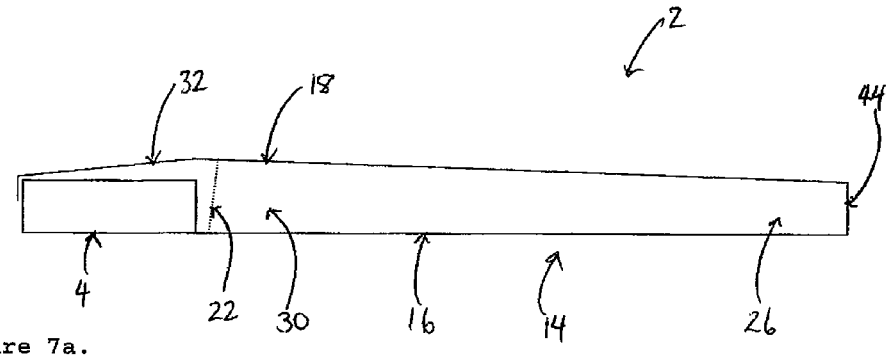
FIG. 7(*a*) is a schematic longitudinal cross section along section 7-7 of FIG. 6 with the net in a first extended position.
Figure 7B:
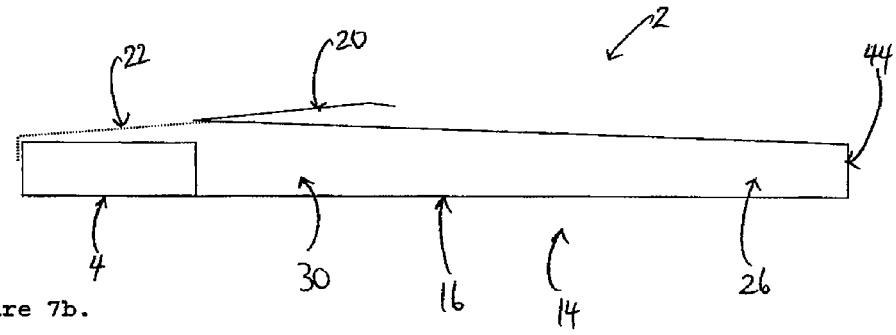

In one form, the canopy 32 shown in FIGS. 6 and 7(*a*) is erected via eyelets 34 strategically placed on the top sheet 18 such that a canopy is formed when ropes 36 that are attached to the eyelets 34 are tethered to an external object, for example, a tree or the ground using pegs. The ropes 36 can be folded up and stored in rope pockets 38.

As an alternative, bracing struts, support poles, ground pegs or other support devices may be connected to or received in the top sheet to create a stable canopy configuration.

The top sheet 18 could include a transparent window (not shown) made of plastics or other suitable material, so that, when in the canopy form, a user can see outside.

As illustrated in FIG. 4, the ground sheet 18 is enlarged and can be folded over itself and secured via press studs 40 to provide additional insulation from the ground as well as a pocket for the mattress. An end flap 44 at the base 26 of the ground sheet is attached to along a first edge 46 to the ground sheet and an adjacent edge 48 to the cover sheet to close off the end of the bedding by way of a zip 50 or other fastener. The ground sheet may be extended to provide an enlarged floor area.

The ground sheet and top sheet may be made as a single piece from the same material, or may be made from different materials. Practically the ground and top sheets of the bedding are made from a weather proof, lightweight natural, synthetic or composite textile or sheet material. The material is water resistant or water proof, or could instead be coated with a water resistant coating. Examples of suitable materials include canvas, plastic polymers or other polymer, natural fibres including cotton, wool, hemp etc., or blends, such as a polyester and a natural fibre blend.

The portable bedding system could be provided with insulation such as foil lining or other material that will retain heat inside the bedding 14.

In operation, the user is able to carry the bedding system 2 around via the use of the shoulder straps 6 of the backpack 4. Additional belongings are able to be placed in the pockets 8 on the backpack 4 or inside the backpack.

In order to prepare the bedding system for use, the user loosens the draw string 10 to open the backpack 4 and extract the bedding 14. The bedding 14 is unrolled with top sheet 18 folded over ground sheet 16. The edges of the top sheet are fastenable by way of a zip 50, etc. to the ground sheet to form an enclosed area in which the user can lie. If the user prefers to sleep with their head exposed to the elements, then the top sheet 18 can be folded back from the head to cover the is user from shoulders down. In this arrangement, to protect the user's face and belongings the insect-proof lining/net 22 can be used to cover the user's face and the backpack 4.

FIG. 7(*a*) shows one arrangement where the net 22 is draped and/or fastened just above where a user's head would lie in order to protect the head. FIG. 7(*b*) shows another arrangement where the net 22 is extended to cover both the user's head and the backpack 4 with the top sheet 18 folded away from the backpack.

If the user desires to entirely cover themselves with the bedding, a canopy 32 is formed by extending the top sheet 18 over the bag 4 and fastening it to the bag 4 and the ground sheet 16 via the use of a zip or other suitable fastening method. Ropes 36 stored in rope pockets 38 can be used to tether the portable bedding system to stable objects such as a tree, a fence, a bench, etc. The user may then open the bedding system via the zip or other suitable fastener and slide in, leaving the user, and their belongings securely inside.

When it is time to pack up the bedding system 2 the bedding 14 comprising the ground sheet 16 and top sheet 18 is folded over to be no more than the width of the backpack and then the bedding is folded, rolled or stuffed from base 26 towards the backpack 4 and into the backpack. The portable bedding system 2 is then able to be slung onto the user's back and carried away.

The bedding system of the present invention is self-supporting, light-weight and highly portable making it ideal for travellers, campers and specifically for homeless people.

One advantage provided by the invention is the ease of portability that comes from the backpack-type carrying arrangement. This is particularly advantageous to a homeless person who is forced to carry all of their belongings.

The bedding system is compact and includes an aesthetically pleasing bag so that a homeless person may feel more dignified in carrying their bed around discreetly.

The back-pack type bag also provides additional storage space for other belongings while sleeping. This provides a particular advantage to the user, particularly to a homeless person who may be sleeping in an unsecured area, in that they may safely keep all of their belongings securely in the bag which is within the canopy when the swag is erected in one form of the present invention.

Another advantage is that the present invention does not require bracing struts, support poles or ground pegs, making it lighter, more portable and incredibly easy and fast to set up. Such accessories may be optionally used if desired.

The mattress, if used, is not attached to the bedding and can be removed easily. This is advantageous as it is easy to remove and clean without much time or effort and particularly advantageous to homeless people or travellers who may not have access to cleaning apparatus or products.

The portable bedding system is lightweight yet does not compromise on size or durability. It is waterproof and weatherproof, and comprises a detachable full body length mattress to ensure a comfortable sleep whilst maintaining portability.

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A portable bedding system comprising:

bedding, having a head end and a foot end, comprising:

a ground sheet; and a weatherproof top sheet attached to the ground sheet and foldable over the ground sheet as to form an enclosure for a user; and a bag comprising:

a shoulder strap;

a closure;

a first pocket; and a second pocket, the second pocket configured to store the bedding when the bedding is not deployed and configured to store other items when the bedding is deployed;

wherein:

the bag is attached to the bedding; and the first pocket is accessible to the user when the bedding is stored in the second pocket and when the bedding is deployed.

2. The portable bedding system in accordance with claim 1, wherein the bedding further comprises a net.

3. The portable bedding system in accordance with claim 2, wherein the net is attached to an inside surface of the top sheet, at a position closer to the head end of the bedding than the foot end of the bedding, as to expose the net when the head end of the top sheet is folded on itself.

4. The portable bedding system in accordance with claim 3, wherein the net can extend over the bag when the bedding is deployed.

5. The portable bedding system in accordance with claim 1, wherein the bag is releasably attached to the bedding.

6. The portable bedding system in accordance with claim 1, wherein the top sheet can form a canopy.

7. The portable bedding system in accordance with claim 1, wherein the ground sheet is approximately twice as wide as the bag.

8. The portable bedding system in accordance with claim 7, wherein the ground sheet is folded over to form a third pocket for a mattress.

9. The portable bedding system in accordance with claim 8, wherein the ground sheet comprises press studs for attaching the folded ground sheet to itself.

10. The portable bedding system in accordance with claim 1, wherein the bedding further comprises a mattress.

11. The portable bedding system in accordance with claim 1, wherein the ground sheet and top sheet are made of a water resistant or water proof material.

12. The portable bedding system in accordance with claim 11, wherein the bedding is made of a lightweight material.

13. The portable bedding system in accordance with claim 12, wherein the material comprises a natural or synthetic textile or sheet material, or a composite thereof.

14. The portable bedding system in accordance with claim 13, wherein the material is a canvas or a plastic polymer.

15. The portable bedding system in accordance with claim herein the weatherproof top sheet includes a window.

16. The portable bedding system in accordance with claim 1, wherein the bag is a backpack.

17. The portable bedding system in accordance with claim 1, wherein a canopy can be erected using eyelets located on the top sheet and ropes which are attached to the eyelets at one end and tethered to a stable object at the other end.

18. The portable bedding system in accordance with claim 1, wherein the closure comprises a drawstring or a zip.

19. The portable bedding system in accordance with claim 1, wherein the top sheet extends beyond the foot end of the rest of the bedding.

20. The portable bedding system in accordance with claim 1, where in the bag further comprises a handle.

21. The portable bedding system in accordance with claim 1, wherein the bag is attached to the head end of the bedding.

* * * * *